US008779294B2

(12) United States Patent
Sumi et al.

(10) Patent No.: US 8,779,294 B2
(45) Date of Patent: Jul. 15, 2014

(54) FLEXIBLE FLAT CABLE WITH DILUTE COPPER ALLOY CONTAINING TITANIUM AND SULFUR

(75) Inventors: Toru Sumi, Hitachi (JP); Seigi Aoyama, Kitaibaraki (JP); Hiromitsu Kuroda, Hitachi (JP); Hideyuki Sagawa, Tokai (JP)

(73) Assignee: Hitachi Metals, Ltd., Tokyo (JP)

( * ) Notice: Subject to any disclaimer, the term of this patent is extended or adjusted under 35 U.S.C. 154(b) by 309 days.

(21) Appl. No.: 13/276,680

(22) Filed: Oct. 19, 2011

(65) Prior Publication Data

US 2012/0097422 A1 Apr. 26, 2012

(30) Foreign Application Priority Data

Oct. 20, 2010 (JP) ..... 2010-235963

(51) Int. Cl.
*H01B 7/08* (2006.01)
*C22C 9/00* (2006.01)

(52) U.S. Cl.
USPC ..... 174/117 F; 29/825; 420/492; 420/500; 148/432

(58) Field of Classification Search
USPC ..... 174/117 F; 29/825; 420/492, 500; 148/432
See application file for complete search history.

(56) References Cited

U.S. PATENT DOCUMENTS 4,567,321 A * 1/1986 Harayama ..... 174/117 F
4,786,469 A * 11/1988 Weber et al. ..... 420/469
5,077,005 A * 12/1991 Kato ..... 420/469
5,565,045 A * 10/1996 Caron et al. ..... 148/432
5,843,243 A * 12/1998 Kawasaki et al. ..... 148/435
6,022,426 A * 2/2000 Mennucci et al. ..... 148/527
6,077,364 A * 6/2000 Chandler et al. ..... 148/432
6,093,886 A * 7/2000 Bazizi et al. ..... 174/31 R
6,103,188 A * 8/2000 Guixa Arderiu et al. ..... 420/473
6,197,433 B1 * 3/2001 Hatano ..... 428/606
6,627,009 B1 * 9/2003 Matsui et al. ..... 148/433
7,482,540 B2 * 1/2009 Shukushima et al. .... 174/117 R
2005/0161129 A1 * 7/2005 Aoyama et al. ..... 148/554
2006/0157167 A1 * 7/2006 Kuroda et al. ..... 148/554
2007/0015001 A1 * 1/2007 Uno et al. ..... 428/655
2008/0283159 A1 * 11/2008 Aoyama et al. ..... 148/554
2010/0163139 A1 * 7/2010 Aoyama et al. ..... 148/554
2010/0263905 A1 * 10/2010 Aoyama et al. ..... 174/107

(Continued)

FOREIGN PATENT DOCUMENTS

JP 63-061703 3/1988
JP 09-256084 9/1997

(Continued)

*Primary Examiner* — Jeremy C Norris
*Assistant Examiner* — Nathan Milakovich
(74) *Attorney, Agent, or Firm* — Brundidge & Stanger, P.C.

(57) ABSTRACT

The present invention provides a flexible flat cable having high conductivity and high bending durability, and a method for manufacturing the same. The present invention is a flexible flat cable comprising conductors and insulating films applied over the conductors, wherein the conductor is comprised of at least one additive element selected from the group consisting of magnesium (Mg), zirconium (Zr), niobium (Nb), calcium (Ca), vanadium (V), nickel (Ni), manganese (Mn), titanium (Ti), and chromium (Cr); 2 mass-ppm or more of oxygen; and the balance being inevitable impurity and copper, wherein the conductor has such a recrystallized texture that the size of crystal grains in the inner area of the conductor is large and that of in the surface area thereof is smaller than that of the inner area, wherein both sides of the conductor are sandwiched between insulating films.

4 Claims, 6 Drawing Sheets

(56) References Cited

U.S. PATENT DOCUMENTS

| | | | | |
|---|---|---|---|---|
| 2012/0097420 | A1* | 4/2012 | Aoyama et al. | 174/113 R |
| 2012/0097904 | A1* | 4/2012 | Kuroda et al. | 252/513 |
| 2012/0100390 | A1* | 4/2012 | Kuroda et al. | 428/640 |
| 2012/0305286 | A1* | 12/2012 | Aoyama et al. | 174/113 R |
| 2012/0325517 | A1* | 12/2012 | Uzoh et al. | 174/126.2 |
| 2013/0022831 | A1* | 1/2013 | Sagawa et al. | 428/606 |
| 2013/0042949 | A1* | 2/2013 | Sagawa et al. | 148/576 |
| 2014/0000932 | A1* | 1/2014 | Aoyama et al. | 174/105 R |

FOREIGN PATENT DOCUMENTS

| | | | |
|---|---|---|---|
| JP | 11-111070 | | 4/1999 |
| JP | 2002-363668 | | 12/2002 |
| JP | 2006274384 | A * | 10/2006 |
| JP | 2012089359 | A * | 5/2012 |

* cited by examiner

FLEXIBLE FLAT CABLE WITH DILUTE COPPER ALLOY CONTAINING TITANIUM AND SULFUR

TECHNICAL FIELD

The present invention relates to a novel flexible flat cable and a method of manufacturing the same.

BACKGROUND ART

In the science and technology in recent years, electricity is used in every part of technical fields in a form of such as a power source and an electrical signal. For conveying or transmitting them, cables and lead wires are used. As the raw material for such cables and wires, metals having high-conductivity, such as copper and silver, are used. Particularly, copper wires are very widely used from the viewpoint of cost.

The material denoted by simply "copper" is classified roughly into hard copper and soft copper (annealed copper) according to its molecular sequence. With this variety, a copper having desired property is used according to the usage purpose.

As the lead wires for electronic parts wiring, hard drawn copper wires are widely used. For example however, cables for electronic devices such as medical instruments, industrial robots, and notebook personal computers are used under such an environment as imposes the cables harsh external force, a composite-forces of bending, twisting, pulling, etc. Therefore, hard drawn copper wires are not suitable for such use and accordingly soft annealed copper wires are used.

The copper wire for such use is required to have a good conductivity (high conductivity) and a good bending durability, which are conflicting characteristics. To date, developments have been furthered for copper-material that has high conductivity with high durability against bending (see Patent Literatures 1 and 2).

For example, the invention defined in JP2002-363668 A (Patent Literature 1) relates to a conductor for a bending-durable cable having good properties in tensile strength, tensile elongation, and conductivity. Particularly, the literature describes a conductor of copper alloy wire for bending-durable cables using an oxygen free copper having a purity of 99.99 mass-% or more with addition of 0.05 to 0.70 mass-% of indium having a purity of 99.99 mass-% or more and 0.0001 to 0.003 mass-% of phosphorus having a purity of 99.9 mass-% or more.

The invention defined in JP09-256084 A (Patent Literature 2) relates to a bending-durable copper alloy wire, wherein the alloy includes 0.1 to 1.0 mass-% of indium and 0.01 to 0.1 mass-% of boron, and the balance is copper.

In general, a flat cable has such a construction: that multiple number of strip-like conductors, or so-called flat conductors, are arrayed flat on one common plane; that the array of the flat conductors is sandwiched between insulating films from the direction of the conductor-thickness, wherein one face of each of the insulating films has an adhesive layer and the films are applied so that each of the adhesive layers will be the inner face of the sandwich on the array of the conductors; and that the sandwich of the array of the flat conductors are hot-pressed by heated rollers applied over the insulating films so that the adhesive layers will be heat-bonded to form a laminated one body.

As the flat conductor, tin-plated or solder-plated annealed tough pitch copper or oxygen free copper is used. As examples of conductors for such kind of flat cables, JP63-617039 U (Patent Literature 3) describes an application of Cu—Sn alloy and JP11-111070 A (Patent Literature 4) describes a use of Cu—Ni—Si alloy.

SUMMARY OF INVENTION

The invention defined in Patent Literature 1 however is an invention related to a hard drawn copper wires only. No particular evaluations have been given in terms of the bending durability; nothing has been discussed regarding annealed copper wires in terms of good bending durability. Further, the invented material contains larger amount of additive element causing lowered conductivity. Therefore, the described invention is not a close-studied art as far as annealed copper concerns.

The invention defined in Patent Literature 2 relates to annealed copper wires. The invented material contains, similarly to the invention defined in Patent Literature 1, larger amount of additive element causing lowered conductivity.

In the meantime, selecting high conductivity copper such as oxygen free copper (OFC) as the raw material can be an idea for ensuring high conductivity for wires.

When oxygen free copper (OFC) is used as the raw material and is applied to products without adding any other elements intending to maintain its inherent conductivity, it seems effective to make the crystalline texture in the material fine giving a high-reduction to copper wire rod during wire drawing process to enhance the bending durability of the wire. However, this practice has a problem in that such processing is suitable for manufacturing hard drawn wires because of work hardening rendered from wire drawing process but is not applicable to manufacturing annealed or soft wires.

The recent trend in the small-sizing of electronics devices has come to require flat cables as the wiring material in devices to have high conductivity and high durability against bending.

Meanwhile, conductors that use the Cu—Sn alloy defined in Patent Literature 3, the Cu—Ni—Sn alloy defined in Patent literature 4, or tough pitch copper are excellent in bending durability; however, they are not fully satisfactory in terms of conductivity. Where conductivity is an important consideration, it is preferable to use the 6N-OFC (a six nines oxygen free copper, i.e., a copper purity of 99.9999 mass-% or more) or an oxygen free copper (less than 2 mass-ppm in oxygen content), however, the property is still not satisfactory in terms of the bending durability.

An object of the present invention is to provide a flexible flat cable having a high conductivity with a high bending durability and a method of manufacturing the same.

The present invention is a flexible flat cable comprising conductors and insulating films applied over the conductors, wherein the conductor is comprised of at least one additive element selected from the group consisting of magnesium (Mg), zirconium (Zr), niobium (Nb), calcium (Ca), vanadium (V), nickel (Ni), manganese (Mn), titanium (Ti), and chromium (Cr); 2 mass-ppm or more of oxygen; and the balance being inevitable impurity and copper, wherein the conductor has such a recrystallized texture that the size of crystal grains in the inner area of the conductor is large and that of in the surface-layer thereof is smaller than that of the inner area, wherein both sides of the conductor are sandwiched between insulating films.

It is preferable that the conductor has a conductivity of 101.5% IACS or higher and is comprised of 4 to 25 mass-ppm of Ti, 3 to 12 mass-ppm of sulfur (S), 2 to 30 mass-ppm of oxygen, and the balance being inevitable impurity and copper.

The reason for selecting the additive element from the group consisting of Mg, Zr, Nb, Ca, V, Ni, Mn, Ti, and Cr is that these elements are active elements that bond easily to other elements. This means that additive of such element can easily trap S included in the conductor and therefore such additive can highly purify the copper base metal (matrix) in the conductor. The additive element may be included more than one kind. Further, another element or impurity that is harmless to the properties of the conductor, namely the alloy comprised of the copper base metal and the additive element, may be included in the alloy.

In the explanation of a preferred embodiment given below, it is described that the oxygen content in the conductor of more than 2 mass-ppm but not larger than 30 mass-ppm renders a good properties. However, the oxygen may be included more than 2 mass-ppm but not larger than 400 mass-ppm depending on the adding amount of the additive element and the content of S within an extent that the alloy still offers the same properties.

The present invention provides a method for manufacturing a flexible flat cable comprising the processes of manufacturing a wire rod from a cast formed at a temperature 1100° C. or higher and 1320° C. or lower through SCR continuous casting-directed rolling system (Southwire Continuous Rod System) using a dilute copper alloy that includes over 2 mass-ppm of oxygen, at least one additive element selected from the group consisting of Mg, Zr, Nb, Ca, V, Ni, Mn, Ti, Cr, and the balance being inevitable impurity and copper; hot-rolling the wire rod; drawing the hot-rolled wire to form a conductor; and sandwiching both sides of the conductor between insulating films.

Preferably, the temperature conditions of the hot-rolling should be 880° C. or lower and 550° C. or higher.

Preferably, the total adding amount of one or more kinds of the additive elements should be 4 to 25 mass-ppm.

The conductor of annealed dilute copper alloy by the present invention, which includes Ti and the balance being inevitable impurity and copper, should preferably be such an annealed dilute copper alloy having a surface-layer that the average crystal grain size in the area from the surface thereof to the depth of 50 μm is 20 μm or smaller.

In SCR continuous casting-directed rolling system (Southwire Continuous Rod System) pertinent to the present invention, the base metal is melted in the melting furnace of SCR continuous casting-directed rolling installation to a molten metal, the intended metal is added to the molten metal to be melted together, and a wire rod (having a diameter of 8 mm for example) is manufactured from such molten metal. The wire rod thus manufactured is hot-rolled into a wire having a diameter of for example 2.6 mm. Wires having diameters of 2.6 mm or smaller, plate materials, and deformed materials are manufactured similarly. Further, it works in rolling round wires into rectangular-shaped or deformed strips; and deformed materials may be manufactured by the conform extrusion using the cast in the SCR continuous casting-directed rolling system.

Conductors of annealed dilute copper alloy by the present invention is an alloy that is obtained from an annealed dilute copper alloy through processing and annealing, wherein the annealed dilute cooper alloy is comprised of 2 to 12 mass-ppm of sulfur, over 2 to 30 mass-ppm or less of oxygen, 4 to 25 mass-ppm of titanium, the balance being inevitable impurity and copper. Because the annealed dilute cooper alloy includes over 2 but not more than 30 mass-ppm of oxygen, what is handled in the embodiments described in this description is so-called low oxygen copper (LOC).

Annealed dilute copper alloy by the present invention is preferably to have a composition, wherein sulfur and titanium added thereto form chemical compound or aggregation mainly in a form of TiO, TiO2, TiS, Ti—O—S and the residual titanium and sulfur exist in a form of solid dispersion.

Annealed dilute copper alloy by the present invention is preferably to have such a composition that TiO having a size of 200 nm or smaller, TiO2 having a size of 100 nm or smaller, TiS having a size of 200 nm or smaller, and Ti—O—S having a size of 300 nm or smaller are distributed in the crystal grains; and that particles having a size of 500 nm or smaller occupy 90% or more.

Annealed dilute copper alloy wire by the present invention is preferably to have such a property that the conductivity of a wire drawn down from the wire rod manufactured therefrom is 98% IACS or higher.

Annealed dilute copper alloy wire by the present invention is preferably to have such a property that the softening temperature in a size of 2.6 mm diameter is 130° C. to 148° C.

Details of preferred modes of embodiments of the present invention are as follows.

First, an object of the present invention is to obtain an annealed dilute copper alloy as a copper material of annealed type that satisfies the requirement for the conductivity to be 101.5% IACS (the percent conductivity defined as International Annealed Copper Standard taking the resistivity of the international standard annealed copper, namely 1.7241×10−8 μm, as 100%). Second, an additional object of the present invention is to develop a material that permits a stable production through SCR continuous casting installation covering a wide range of manufacturing sizes with less surface damage on products and has a softening temperature of 148° C. or lower at the reduction rate applied to the wire rod is 90% (a reduction of 8 mm diameter to 2.6 mm diameter, for example).

The softening temperature of a high-purity copper (six nines, 99.9999% of purity) at the reduction rate applied to the wire rod is 90% is 130° C. Therefore, the inventors of the present invention made a study for an annealed dilute copper alloy as a raw material, together with its manufacturing conditions, that can stably produce an annealed copper of which softening temperature is 130° C. or higher and 148° C. or lower and the conductivity of which under an annealed state is 101.5% IACS.

A wire of 2.6 mm diameter drawn down from a wire rod of 8 mm diameter (where the reduction rate was 90%) manufactured from a molten metal having additive of titanium of several mass-ppm was prepared in a laboratory room with a small continuous casting machine using a high-purity copper (four nines of purity) having 1 to 2 mass-ppm of oxygen concentration. The measuring of the softening temperature of the wire thus prepared showed that the temperature was 160 to 168° C. and softening temperatures lower than this was not attained; the conductivity was about 101.7% IACS. This gave a knowledge that, even the oxygen content is lowered and titanium is added, the softening temperature cannot be lowered and that the conductivity becomes worse than that of a high-purity copper (six nines purity), namely 102.8% IACS.

The reason for this is inferred that several mass-ppm of sulfur, which is included as an inevitable impurity, and titanium in the molten metal did not form an adequate amount of sulfide during manufacturing the molten metal, preventing lowering the softening temperature.

Considering this situation, the present invention has achieved its object by combining two influences revealed through study on two measures, one for lowering the softening temperature and the other for improving the conductivity.

(Dilute copper alloy by the present invention and manufacturing conditions for SCR continuous casting installation)

(1) Alloy Composition

The present invention uses a conductor comprised of additive element selected from the group consisting of Mg, Zr, Nb, Ca, V, Ni, Mn, Ti, and Cr; 2 mass-ppm or more of oxygen; and the balance being inevitable impurity and copper.

To obtain an annealed copper material having a conductivity of 101.5% IACS or higher, it may be appropriate to manufacture a wire rod from an annealed dilute copper alloy provided using a pure copper that includes inevitable impurities, to which 3 to 12 mass-ppm of sulfur, over 2 but not more than 30 mass-ppm of oxygen, and 4 to 25 mass-ppm of titanium are added.

In general, sulfur is unavoidably taken in during manufacturing electrolytic copper in the industrially-manufacturing pure copper; therefore, it is difficult to reduce the sulfur content below 3 mass-ppm. The upper limit of sulfur concentration in general purpose electrolytic copper is 12 mass-ppm.

As stated above, smaller oxygen content invites difficulty in lowering the softening temperature; therefore, oxygen should be controlled over 2 mass-ppm. In contrast, excessive amount of oxygen causes products to be prone to have surface-damage while undergoing hot-rolling process; therefore, oxygen content should be 30 mass-ppm or less.

(2) Dispersed Particles

It is preferable that the dispersed particles in the crystal grain of an annealed dilute copper alloy are small in size and large in quantity. The reason for this is that the dispersed particles work as a deposition site of sulfur; therefore particles are required to be small in size and large in quantity.

The annealed dilute copper alloy is made to have such a composition that sulfur and titanium form chemical compound or aggregation mainly in a form of TiO, TiO2, TiS, Ti—O—S and the residual titanium and sulfur exist in a form of solid dispersion; that TiO having a size of 200 nm or smaller, TiO2 having a size of 100 nm or smaller, TiS having a size of 200 nm or smaller, and Ti—O—S having a size of 300 nm or smaller are distributed in the crystal grains; and that particles having a size of 500 nm or smaller occupy 90% or more.

In addition, setting the casting conditions is also necessary, because the sizes of the dispersed particles produced vary depending on the holding time length of the molten copper at the time of casting and cooling conditions.

(3) Conditions for Continuous Casting-Directed Rolling

In SCR continuous casting-directed rolling system (Southwire Continuous Rod System), the base metal is melted in the melting furnace of SCR continuous casting-directed rolling installation to a molten metal, the intended metal is added to the molten metal to be melted together, and a wire rod (having a diameter of 8 mm for example) is manufactured from such molten metal. The wire rod thus manufactured is hot-rolled into a wire having a diameter of for example 2.6 mm. Wires having diameters of 2.6 mm or smaller, plate materials, and deformed materials are manufactured similarly. Further, it works in manufacturing round wires into rectangular-shaped or deformed strips; and deformed materials may be manufactured by the conform extrusion using the cast.

With SCR continuous casting-directed rolling method, a wire rod is manufactured with a condition that the reduction rate applied over an ingot rod is 90% (30 mm) to 99.8% (5 mm). As an example, a method of manufacturing a wire rod of 8 mm diameter with the reduction rate 99.3% is used.

(a) The temperature of molten copper in the melting furnace is controlled to be 1100° C. or higher but 1320° C. or lower. Because higher temperatures of the molten copper cause generation of increased number of blowholes inviting flaws and the grain size tends to become large, the temperature should not be over 1320° C. The reason to adjust the temperature to 1100° C. or higher is that copper tends to solidify at a temperature below 1100° C. with unstable manufacturing; however, it is preferable that the temperature of the molten copper should be as low as practicable.

(b) The temperatures in the hot-rolling are controlled to be 880° C. or lower at the head end rolls and 550° C. or higher at the finish rolls.

A problem pertinent to the present invention is, different form an ordinary manufacturing condition for pure copper, the crystallization of sulfur in the molten copper and the precipitation of sulfur during hot-rolling. Therefore, for making the solid solubility limit of molten copper lower, it may be appropriate to control temperatures of the molten copper and hot-rolling to be such temperatures as defined in items (a) and (b) stated above.

Although the temperatures in a conventional hot-rolling are 980° C. at the head end rolls and 600° C. at the finish rolls, it is necessary for lowering above-stated solid solubility limit of molten copper to adjust the temperature to 880° C. or lower at the head end rolls and 550° C. or higher at the finish rolls.

The reason to adjust the temperature to 550° C. or higher is that, if the temperature is lower than that, the wire rod will have increased flaws preventing the wire rod from being products with acceptable quality. It is preferable that the temperatures in hot-rolling are to be 880° C. or lower at the head end rolls and 550° C. or higher but as lower as practicably possible at the finish rolls. Thereby, the softening temperature (after reduction from 8 mm diameter to 2.6 mm diameter) becomes infinitely close to the softening temperature of a high-purity copper (six nines of purity and 130° C. of softening temperature).

(c) An annealed dilute copper alloy is obtainable, wherein the alloy has such a property that the conductivity in the form of wire rod of 8 mm diameter is 102% IACS or higher and the softening temperature in a form of a cold-drawn wire (a wire of 2.6 mm diameter for example) is 130° C. to 148° C. The alloy exhibits similar characteristics to those exhibited in the 2.6 mm wire also in a form of plate material.

The conductors for the flat flexible cable (FFC) by the present invention should preferably have a conductivity higher than that of the conventional tough pitch copper and therefore it is necessary that the conductivity is 101.5% IACS or higher; the softening temperature is 148° C. or lower from the viewpoint of industrial value. Where Ti is not added, the softening temperature is 160 to 165° C. Because the softening temperature of a high-purity copper (six nines of purity) was 127 to 130° C., the limit is defined as 130° C. based on data obtained. This little difference comes from the inevitable impurity that is not included in a high-purity copper (six nines of purity).

(4) Manufacturing Conditions for Shaft Furnace

It may be appropriate in processing copper after melted in a shaft furnace to use a method that can manufacture wire rods stably; that is, casting and rolling are performed controlling concentration of constituting elements of dilute alloy, namely, sulfur, titanium, and oxygen, in the trough controlled to be in a reductive state namely in an atmosphere of reductive gas (CO).

Mixing copper oxides may occur and sizes of grain will be large; consequently quality will be degraded.

The reason for choosing Ti as the additive is as follows.

(a) Ti easily forms a compound in the molten copper through bonding with sulfur.

(b) Ti permits working and therefor is easy to handle compared to other additive metals such as Zr.

(c) Ti is inexpensive compared to such as Ni.

(d) Ti easily precipitates out taking oxides as its seed.

Thus, the dilute copper alloy material by the present invention is usable as hot-solder-dipped materials (wires, strips, foils), annealed pure copper, high-conductivity copper, and soft copper wires. The present invention permits to provide a practical dilute copper alloy material having a high productivity and excellent properties in conductivity, softening temperature, and surface quality.

It may be practicable to provide a plated layer on the surface of the dilute copper alloy wire of the present invention. As the plated layer, it is feasible to use a plating material of which main constituents are tin, nickel, and sliver for example; use of so-called lead-free plating is also feasible.

In the explanation of the embodiment stated above, wire rods are manufactured through SCR continuous casting-directed rolling method and annealed materials are prepared through a hot-rolling using such wire rods. The present invention is also applicable to manufacturing methods that use twin-roll type continuous casting-directed rolling system or Properzi type continuous casting-directed rolling system.

Advantages of the Invention

The advantageous effect of the present invention includes providing a flexible flat cable comprised of an annealed dilute copper alloy material having such a property that high conductivity and high bending durability is achieved even in a form of annealed copper material and offering a method for manufacturing such flexible flat cable.

BEST MODE FOR CARRYING OUT THE INVENTION

Embodiment Mode 1

Figure 1:
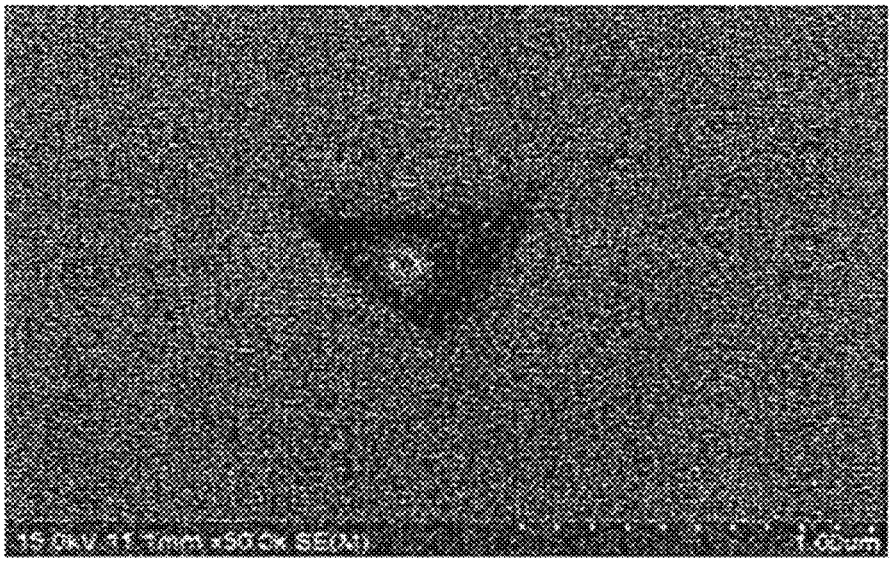
FIG. 1 is a SEM image of TiS particles.

Table 1 lists results and relevant conditions of measuring conducted on the annealed dilute copper alloy materials by or pertinent to the present invention in terms of oxygen concentration, S concentration, Ti concentration, half-softening temperature, conductivity, dispersed particle size, and overall evaluation.

TABLE 1

| Experimental Material | Oxygen Concentration (mass-ppm) | Sulfur Concentration (mass-ppm) | Titanium Concentration (mass-ppm) | 2.6 mm diam. Wire Half-softening Temperature. (° C.) | | 2.6 mm diam. Annealed Wire Conductivity (% IACS) | Dispersed Particle Size Evaluation | Overall Evaluation |
|---|---|---|---|---|---|---|---|---|
| Comparison | 1 to below 2 | 5 | 0 | 215 | x | 101.7 | ○ | x |
| Material 1 | 1 to below 2 | 5 | 7 | 168 | x | 101.5 | ○ | x |
| (through | 1 to below 2 | 5 | 13 | 160 | x | 100.9 | ○ | x |
| small continuous | 1 to below 2 | 5 | 15 | 173 | x | 100.5 | ○ | x |
| casting apparatus) | | | 18 | 190 | x | 99.6 | ○ | x |
| Comparison | 7 to 8 | 3 | 0 | 164 | x | 102.2 | ○ | x |
| Material 2 | 7 to 8 | 5 | 2 | 157 | x | 102.1 | ○ | x |
| (through SCR) | | | | | | | | |
| Embodiment | 7 to 8 | 5 | 4 | 148 | ○ | 102.1 | ○ | ○ |
| Material 1 | 7 to 8 | 5 | 10 | 135 | ○ | 102.2 | ○ | ○ |
| (through SCR) | 7 to 8 | 5 | 13 | 134 | ○ | 102.4 | ○ | ○ |
| | 7 to 8 | 5 | 20 | 130 | ○ | 102.2 | ○ | ○ |
| | 7 to 8 | 5 | 25 | 132 | ○ | 102.0 | ○ | ○ |
| Comparison | 7 to 8 | 5 | 37 | 134 | ○ | 101.1 | ○ | x |
| Material 3 | 7 to 8 | 5 | 40 | 135 | ○ | 99.6 | ○ | x |
| (through SCR) | 7 to 8 | 5 | 55 | 148 | ○ | 98.2 | ○ | x |
| Comparison | 7 to 8 | 5 | 60 | 155 | x | 97.7 | x | x |
| Material 4 | | | | | | | Surface | |
| (through SCR) | | | | | | | quality is bad. | |
| Embodiment | Below 2: | 5 | 13 | 145 | ○ | 102.1 | ○ | Δ |
| Material 2 | Hard for | | | | | | | |
| (through SCR) | steady control | | | | | | | |
| | 2 to 3 | 5 | 11 | 133 | ○ | 102.2 | ○ | ○ |
| | 3 | 5 | 12 | 133 | ○ | 102.2 | ○ | ○ |
| | 30 | 5 | 10 | 134 | ○ | 102.0 | ○ | ○ |

TABLE 1-continued

| Experimental Material | Oxygen Concentration (mass-ppm) | Sulfur Concentration (mass-ppm) | Titanium Concentration (mass-ppm) | 2.6 mm diam. Wire Half-softening Temperature. (° C.) | | 2.6 mm diam. Annealed Wire Conductivity (% IACS) | Dispersed Particle Size Evaluation | Overall Evaluation |
|---|---|---|---|---|---|---|---|---|
| Comparison Material 5 (through SCR) | 40 | 5 | 14 | 134 | ○ | 101.8 | x Surface quality is bad. | x |
| Embodiment Material 3 (through SCR) | 7 to 8 | 2 | 4 | 134 | ○ | 102.2 | ○ | ○ |
| | 7 to 8 | 10 | 13 | 135 | ○ | 102.3 | ○ | ○ |
| | 7 to 8 | 12 | 14 | 136 | ○ | 102.2 | ○ | ○ |
| | 7 to 8 | 11 | 19 | 133 | ○ | 102.4 | ○ | ○ |
| | 7 to 8 | 12 | 20 | 133 | ○ | 102.4 | ○ | ○ |
| Comparison Material 6 (through SCR) | 7 to 8 | 18 | 13 | 136 | x | 101.5 | ○ | x |
| Comparison Material 7 (Six nines copper) | | | | 127 to 130 | ○ | 102.8 | Not applicable | Not conducted |

Note:
Mark ○ denotes property is good, Δ conditional good, and x not acceptable.

First, 8 mm diameter of copper wires (wire rods) having oxygen concentration, sulfur concentration, and Ti concentration as indicated in Table 1, and experienced 99.3% of reduction were prepared. These 8 mm diameter copper wires are hot-rolled material through SCR continuous casting-directed rolling process. Addition of Ti was performed in the casting pot. That is, the molten copper issued from the shaft furnace was flowed in the trough in a reductive gas atmosphere and introduced into the casting pot also in a reductive gas atmosphere, in which titanium was added. The molten copper, after the addition of Ti, was poured through the nozzle in a casting mold created between the casting wheel and the endless belt to manufacture an ingot rod. Applying hot-rolling on the ingot rod, a copper wire of 8 mm diameter, an experimental material, was manufactured. From the experimental material, a wire of 2.6 mm diameter was prepared by cold drawing and the half-softening temperature and the conductivity thereof were measured. Further, the dispersed particle size in the copper wire of 8 mm diameter was evaluated.

Oxygen concentration was measured with an oxygen analyzer (Leco™ Oxygen Analyzer). Concentrations of sulfur and Ti were the results obtained using Inductively Coupled Plasma (ICP) emission spectral analyzer.

The half-softening temperature of 8 mm diameter copper wire was obtained based on tensile strengths of specimens measured after heat-experiences such that, first, the specimens were held lower than 400° C. for one hour and then underwent quick water-cooling. The tensile strength of a copper wire was examined under two conditions: one at the room temperature and the other after heat treatment of dipping in a 400° C. oil-bath for one hour. These two tensile strengths were added together and the sum was divided by two to obtain the average value of them. A temperature that corresponds to the average value thus obtained was defined as the half-softening temperature.

It is preferable that the dispersed particles are small in size and large in quantity. The reason for this is that the dispersed particles work as a deposition site of sulfur; therefore particles are required to be small in size and large in quantity. Therefore, where 90% or more portion of a specimen is occupied by dispersed particles having diameter of 500 μm or smaller, such specimen was classified into an acceptable material. The "size" used in this description means the size of the compound and represents the longer-diameter of the major and the minor axes of the shape of the compound. The "particle" used in this description means those above-stated substances: TiO, TiO2, TiS, and Ti—O—S. The "90%" means the ratio of number of corresponding particles to the overall number of all particles.

In Table 1, the data for comparison material 1 is the results obtained form an 8 mm diameter copper wire experimentally manufactured in the laboratory room under argon (Ar) atmosphere, wherein Ti was added in a quantity of 0 to 18 mass-ppm.

By this Ti-addition, the softening temperature lowered to a minimum of as low as 160° C. when the addition was 13 mass-ppm in contrast to the half-softening temperature of 215° C. where no Ti was added, but the softening temperature rose and did not lower below the desired temperature of 148° C. when the addition was 15 and 18 mass-ppm. Further, the conductivity being 102% or higher was not satisfied. Therefore, the overall evaluation was "Not acceptable (x)".

Then, another 8 mm diameter copper wire (wire rod) was experimentally manufactured through SCR continuous casting-directed rolling method regulating the oxygen concentration to 7 to 8 mass-ppm.

Comparison material 2 is a material of which Ti concentration is lower (0.2 mass-ppm) among those materials manufactured through SCR continuous casting-directed rolling method. The conductivity thereof is 101.5% IACS or higher but the half-softening temperature thereof is 164° C. and 157° C. that do not satisfy the requirement of 148° C. Therefore, the overall evaluation was "Not acceptable (x)".

As for Embodiment material 1, the indicated results are properties of the experimentally manufactured material of which oxygen concentration is 7 to 8 mass-ppm, sulfur concentration is 5 mass-ppm (almost constant), Ti concentrations are from 4 to 25 mass-ppm in different adding amount.

Within the Ti-addition range from 4 to 25 mass-ppm, the softening temperature is 148° C. or lower and the conductivity is 101.5% IACS or higher and the occupation of the dispersed particles having 500 μm or smaller is as good as 90% or more. Further, the surface quality of the wire rod is smooth enough that satisfies requirement for the product quality. (Overall evaluation ○.)

The material that satisfies the conductivity of 101.5% IACS is a material of which Ti concentration is 4 to 25 mass-ppm. The conductivity showed the maximum of 102.4% IACS when the Ti concentration was 13 mass-ppm and showed a little lower value around such concentration. This indicates that, when the concentration of Ti was 13 mass-ppm, Ti trapped sulfur in copper in a form of compound and thereby a conductivity became close to the one in a pure copper (six nines of purity).

Therefore, bringing the oxygen concentration rich and adding Ti can make requirements for both the half-softening temperature and conductivity satisfied.

Comparison material 3 is an experimentally manufactured material of which Ti concentration is in excess of 25 mass-ppm. Comparison material 3 satisfies the requirement for the half-softening temperature but the conductivity thereof is below 101.5% IACS; therefore, the overall evaluation was "Not acceptable (x)".

Comparison material 4 is an experimentally manufactured material of which Ti concentration is as high as 60 mass-ppm. Comparison material 4 satisfies the requirement for conductivity but the half-softening temperature is 148° C., which does not satisfy the requirement for product quality. Further, the wire rod thus obtained had many surface flaws and because of that it was difficult to handle as a commercially acceptable product. Therefore, it is desirable that the adding amount of Ti should be below 60 mass-ppm or larger.

Embodiment material 2 is an experimentally manufactured material, wherein the sulfur concentration was 5 mass-ppm and the Ti concentration was 10 to 13 mass-ppm, and oxygen concentration was varied to investigate the influence of the oxygen concentration.

Regarding oxygen concentration, the experimental material was given a wide range of variety from over 2 mass-ppm to 30 mass-ppm or lower of different concentrations. Where the oxygen concentration is below 2 mass-ppm, the manufacturing was difficult and was not able to maintain stability; therefore, the overall evaluation was "Conditional good (Δ)". On the other hand, it was found that, even though the oxygen concentration was made as high as 30 mass-ppm, both the half-softening temperature and the conductivity were satisfactory.

As data for Comparison material 5 indicates, the wire rod has many surface flaws when the oxygen concentration is 40 mass-ppm, which prevents the material from being a commercially acceptable product.

Thus, the oxygen concentration being over 2 and 30 mass-ppm or lower makes the requirements for half-softening temperature, for the conductivity being 101.5% IACS, and for sizes of dispersed particles all satisfied; and further, the surface of the wire rod is smooth. Each of these properties satisfies the requirements for the product quality.

Embodiment material 3 is an experimentally manufactured material example, wherein oxygen concentration and Ti concentration were made comparatively close value each other and sulfur concentration was varied from 4 to 20 mass-ppm. In this Embodiment material 3, a trial specimen of which sulfur concentration was 2 mass-ppm was not obtained because of raw material-aspect limitation. However, controlling Ti concentration and sulfur concentration is able to make the material satisfy both the half-softening temperature and the conductivity.

When sulfur concentration was 18 mass-ppm and Ti concentration was 13 mass-ppm in Comparison material 6, the half-softening temperature was as high as 162° C., which did not satisfy intended requirements. Particularly, the surface quality of the wire rod was bad. Thus, putting this material into a commercial product was not feasible.

From the above, it was found that, where sulfur concentration was 2 to 12 mass-ppm, the material satisfied all the requirements for half-softening temperature, for the conductivity to be 101.5% IACS, and for sizes of dispersed particles, further that the wire rod surface was smooth. Thus, the material was found satisfactory in all aspects of the product quality.

Results of examination conducted on Comparison material 7 that used copper of six nines of purity is also listed. The half-softening temperature was 127 to 130° C. and the conductivity was 102.8% IACS, and dispersed particles having a size of 500 μm or smaller were not found at all.

TABLE 2

| Experimental Material | Molten Copper Temp. (° C.) | Oxygen Concentration (mass-ppm) | Sulfur Concentration (mass-ppm) | Titanium Concentration (mass-ppm) | Hot Rolling Temp. (° C.) Head End to Finish | 2.6 mm diam. Wire Half-softening Temp. (° C.) | 2.6 mm diam. Annealed Wire Conductivity (% IACS) | Wire Rod Surface Quality | Dispersed Particle Size Evaluation | Overall Evaluation |
|---|---|---|---|---|---|---|---|---|---|---|
| Comparison | 1350 | 15 | 7 | 13 | 950-600 | 148 | 101.7 | x | x | x |
| Material 8 | 1330 | 16 | 6 | 11 | 950-600 | 147 | 101.2 | x | x | x |
| Embodiment | 1320 | 15 | 5 | 13 | 880-550 | 143 | 102.1 | ○ | ○ | ○ |
| Material 4 | 1300 | 16 | 6 | 13 | 880-550 | 141 | 102.3 | ○ | ○ | ○ |
| | 1250 | 15 | 6 | 14 | 880-550 | 138 | 102.1 | ○ | ○ | ○ |
| | 1200 | 15 | 6 | 14 | 880-550 | 135 | 102.1 | ○ | ○ | ○ |
| Comparison Material 9 | 1100 | 12 | 5 | 12 | 880-550 | 135 | 102.1 | x | ○ | x |
| Comparison Material 10 | 1300 | 13 | 6 | 13 | 950-600 | 147 | 101.5 | ○ | x | x |
| Comparison Material 11 | 1350 | 14 | 6 | 12 | 880-550 | 148 | 101.5 | x | x | x |

Note:
Mark ○ denotes property is good, Δ conditional good, and x not acceptable.

Table 2 lists molten copper temperatures and rolling temperatures as the manufacturing conditions, half-softening temperatures, conductivities, surface conditions, dispersed particle sizes, and overall evaluations.

Comparison material 8 is an experimentally manufactured 8 mm diameter wire rod, wherein the temperature of molten copper was a relatively higher temperature of 1330 to 1350° C. and the temperature of rolling was 950 to 600° C.; the table lists properties of this material.

Comparison material 8 satisfied requirements for the half-softening temperature and the conductivity. However, in terms of the size of dispersed particles in the material, the material included particles of about 1000 nm in size and particles of 500 nm or larger in size occupied 10% or more. This aspects is not acceptable; therefore, overall evaluation was "Not acceptable (x)".

Embodiment material 4 is an experimentally manufactured 8 mm diameter wire rod, wherein the temperature of molten copper was 1200 to 1320° C. and the temperature of rolling was a relatively lower temperature of 880 to 550° C.; the table lists properties of this material. This Embodiment material 4 had a good wire surface quality and the sizes of the dispersed particles thereof were also good; the overall evaluation was therefore "Acceptable (○)".

Comparison material 9 is an experimentally manufactured 8 mm diameter wire rod, wherein the temperature of molten copper was 1100° C. and the temperature of rolling was a relatively lower temperature of 880 to 550° C.; the table lists properties of this material. This Comparison material 9 was not suitable for putting into a commercial product because of a lot of defects on the wire rod surface due to the temperature of molten copper being low. The reason for this is that rolling is prone to make flaws on the surface of the wire rod if the temperature of the molten copper is low. Thus, the overall evaluation was "Not acceptable (x)".

Comparison material 10 is an experimentally manufactured 8 mm diameter wire rod, wherein the temperature of molten copper was 1300° C. and the temperature of rolling was a relatively higher temperature of 950 to 600° C.; the table lists properties of this material. Comparison material 10 had a good quality in the wire rod surface by virtue of the temperature of molten copper being higher, but the size of some of the dispersed particles therein were large. Therefore, the overall evaluation was "Not acceptable (x)".

Comparison material 11 is an experimentally manufactured 8 mm diameter wire rod, wherein the temperature of molten copper was 1350° C. and the temperature of rolling was a relatively lower temperature of 880 to 550° C.; the table lists properties of this material. This Embodiment material 11 included dispersed particles the size of some of which was large due to the temperature of the molten copper being higher; therefore, the overall evaluation was "Not acceptable (x)".

(Dispersed Particles)

Figure 2:
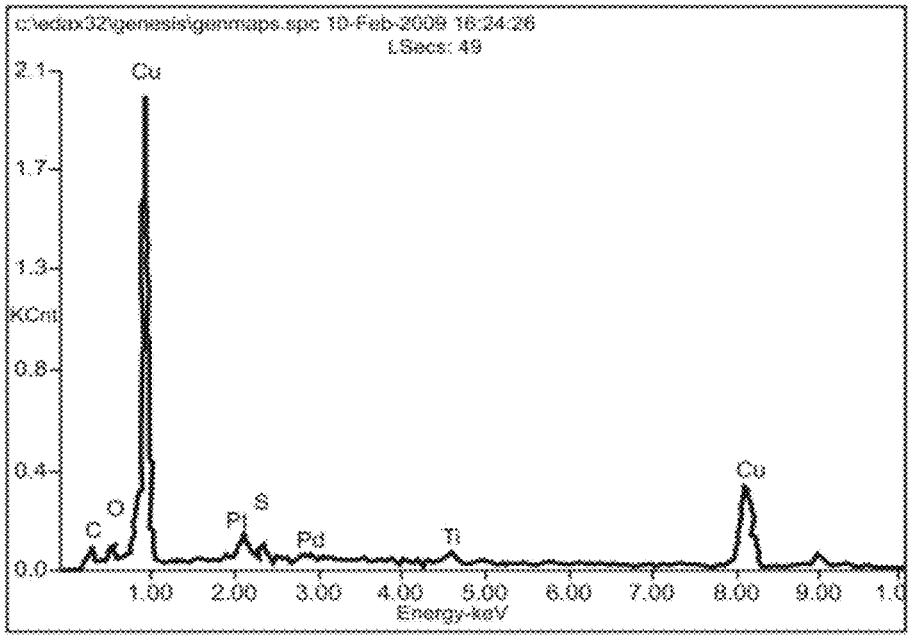
FIG. 2 shows analysis results of FIG. 1.
Figure 3:
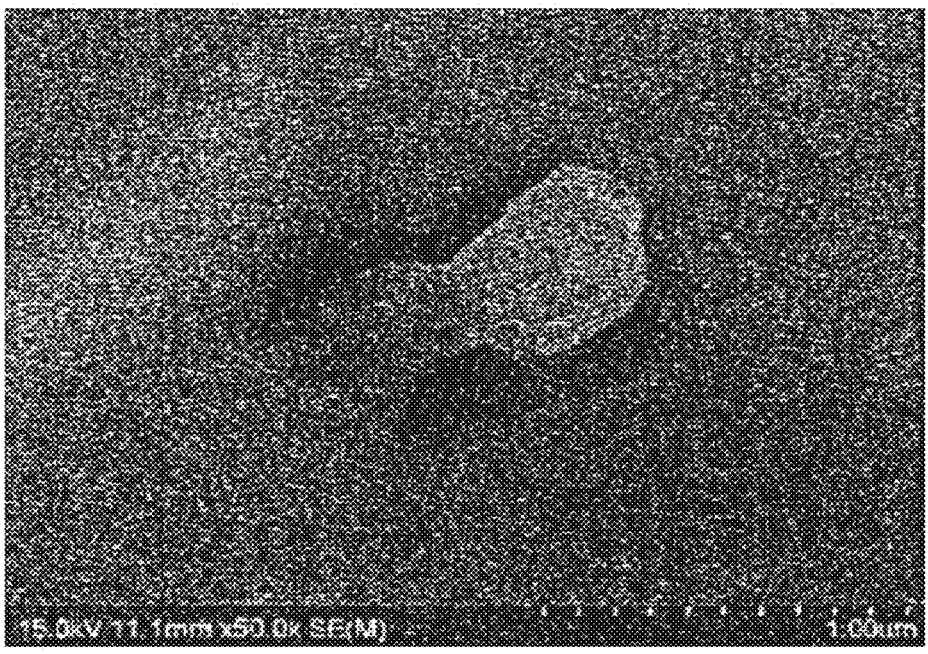
FIG. 3 is a SEM image of TiO2 particles.
Figure 4:
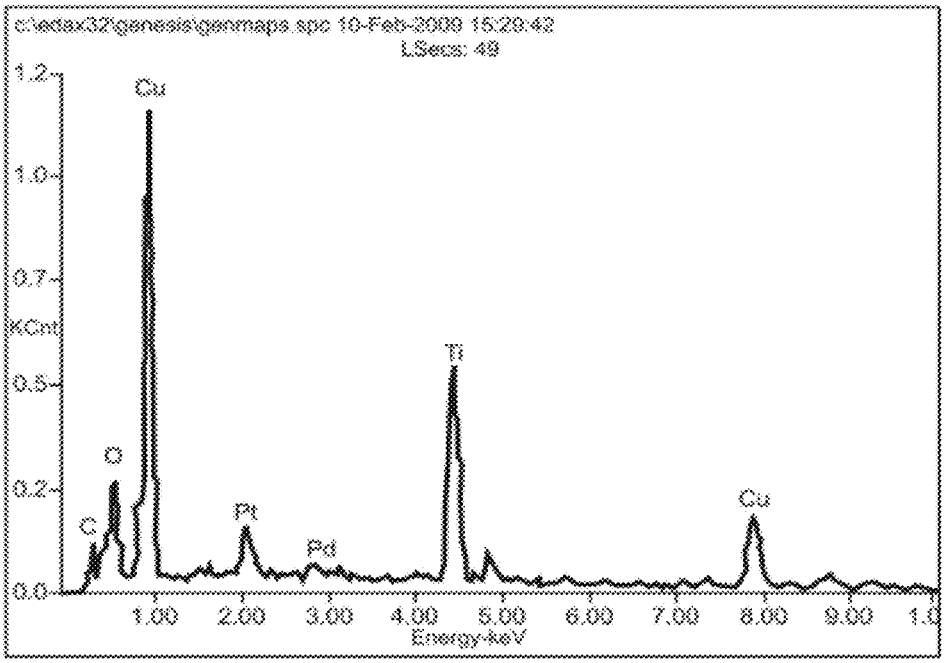
FIG. 4 shows analysis results of FIG. 3.
Figure 5:
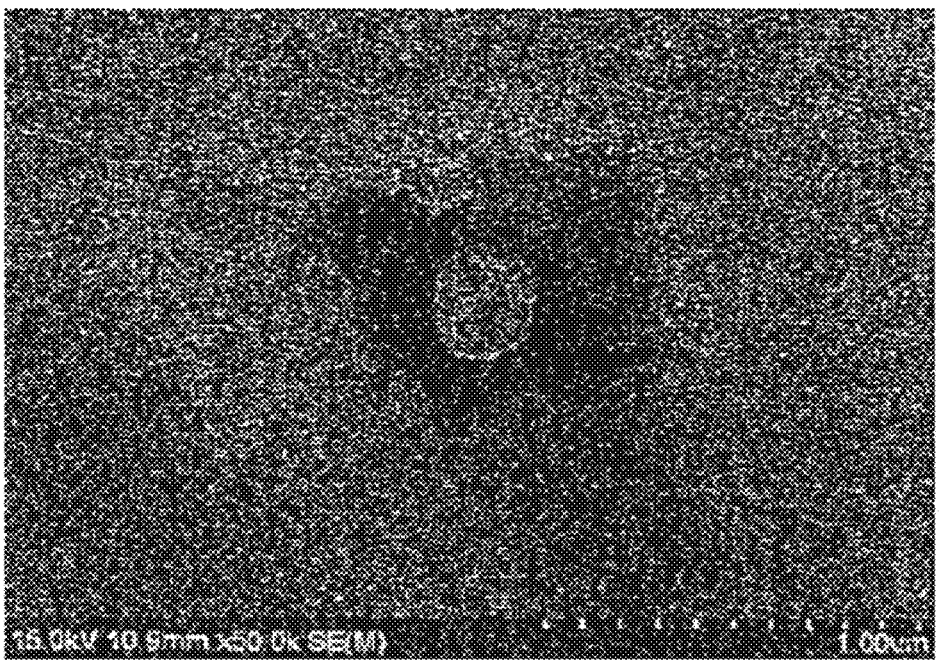
FIG. 5 is a SEM image of Ti—O—S particles in the present invention.
Figure 6:
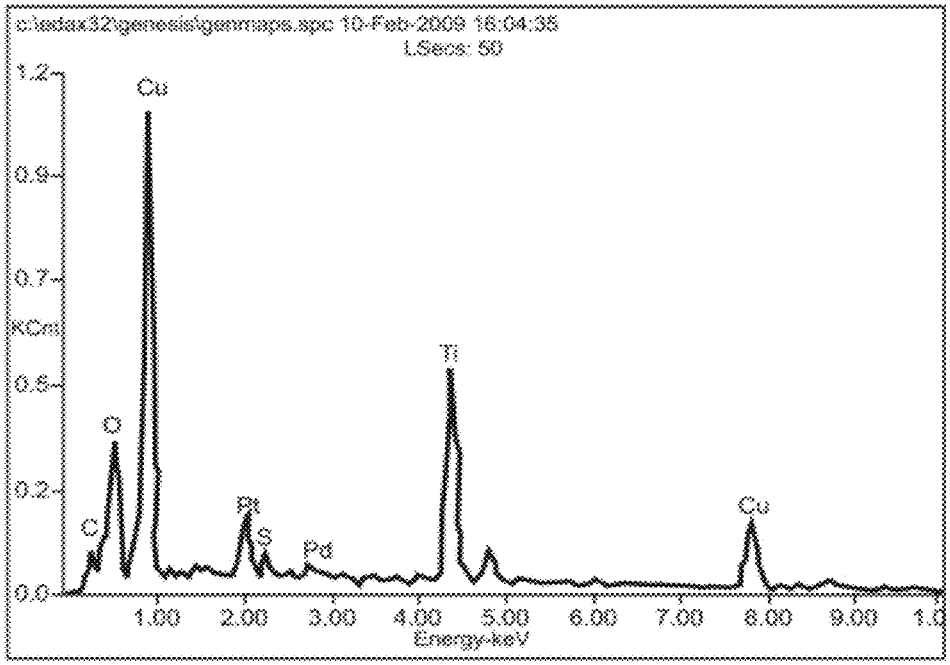
FIG. 6 shows analysis results of FIG. 5.

(a) Titanium is added with the oxygen concentration of the raw material being increased in excess of 2 mass-ppm. It is inferred that, as a consequence of this addition, TiS, oxide of titanium oxides (TiO2), and particles of Ti—O-S will first be produced in the molten copper (Refer to SEM images in FIGS. 1 and 2, and results of analysis indicated in FIGS. 2 and 4.). Pt (platinum) and Pd (palladium) appeared in FIGS. 2, 4, and 6 are elements vapor-deposited to help specimen observation.

(b) Following the above, the temperature of hot rolling is controlled at temperatures lower (namely, 880° C. at the head end rolls down to 550° C. at the finish rolls) than those in the conventional copper-processing conditions (namely, 950° C. at the head end rolls down to 600° C. at the finish rolls) to introduce dislocations in the copper for easy precipitation of sulfur. Thereby, sulfur is made to precipitate on dislocations or on the seed of oxide of titanium (TiO2) and Ti—O-S particles, as an example, are made to form similarly to the case of molten copper (Refer to SEM image in FIG. 5 and results of analysis indicated in FIG. 6.). FIGS. 1 to 6 show the properties of the wire rod of 8 mm diameter having oxygen concentration, sulfur concentration, and titanium concentration listed as the third specimen indicated on the third line from the top in the row for Embodiment material 1 in Table 1. Indicated properties are the SEM-observed image of the cross section of the wire rod and results of EDX-analysis. The observation conditions were 15 keV in the acceleration voltage and 10 μA in the emission current.

By making the sulfur in copper crystallize and precipitate based on the knowledge described in (a) and (b) above, a copper wire rod that satisfies the requirements for the softening temperature and the conductivity can be manufactured.

(Softening Properties of Annealed Dilute Copper Alloy Wire)

Table 3 indicates the results of examination for Vickers hardness (Hv) of Comparison material 12 that uses oxygen free copper and Embodiment material 5 that uses an annealed dilute copper alloy wire which includes 13 mass-ppm of Ti, wherein each of materials were annealed for one hour under different temperatures.

Embodiment material 5 used such an alloy as included 13 mass-ppm of Ti among Embodiment materials 1 listed in Table 1. A specimen having 2.6 mm diameter was used for the examination of hardness. As the table shows, Vickers hardness (Hv) of Comparison material 12 and Embodiment material 5 are at comparable level when the annealed at 400° C. and are also comparable value when the annealed at 600° C. This indicates that the annealed dilute copper alloy wire by the present invention has an appropriate softness and has an excellent softness compared with oxygen free copper particularly when the annealing temperature is higher than 400° C.

As stated above, a practical material of high productivity having excellent conductivity, softening temperature and surface quality as the dilute copper alloy for use in a flexible flat cable (FFC) can be obtained based on these Embodiment materials.

In contrast, any of Comparison materials showed a low productivity as the dilute copper alloy material for FFC and the conductivity, softening temperature, and surface quality thereof were inferior; no practically useful material was obtained.

TABLE 3

| | 20° C. | 400° C. | 600° C. |
|---|---|---|---|
| Embodiment Material 5 | 120 | 52 | 48 |
| Comparison Material 12 | 124 | 53 | 56 |

(Unit: Hv)

(Proof Stress and Bending Life of Annealed Dilute Copper Alloy Wire)

Table 4 lists examination results of the transition of 0.2% proof stress of Comparison material 13 that uses oxygen free copper and Embodiment material 6 that uses such an annealed dilute copper alloy wire as includes 13 mass-ppm of Ti among Embodiment material 1, after annealing for one hour under different temperatures. A specimen having 2.6 mm diameter was used for the examination of hardness.

According to the table, it is known that the 0.2% proof stresses of Comparison material 13 and Embodiment material 6 when the annealing temperature is 400° C. are at comparable level and are also comparable value when the annealed at 600° C.

TABLE 4

| | 20° C. | 250° C. | 400° C. | 600° C. | 700° C. |
|---|---|---|---|---|---|
| Embodiment Material 6 | 421 | 80 | 58 | 35 | 25 |
| Comparison Material 13 | 412 | 73 | 53 | 32 | 24 |

(Unit: MPa)

Figure 7:
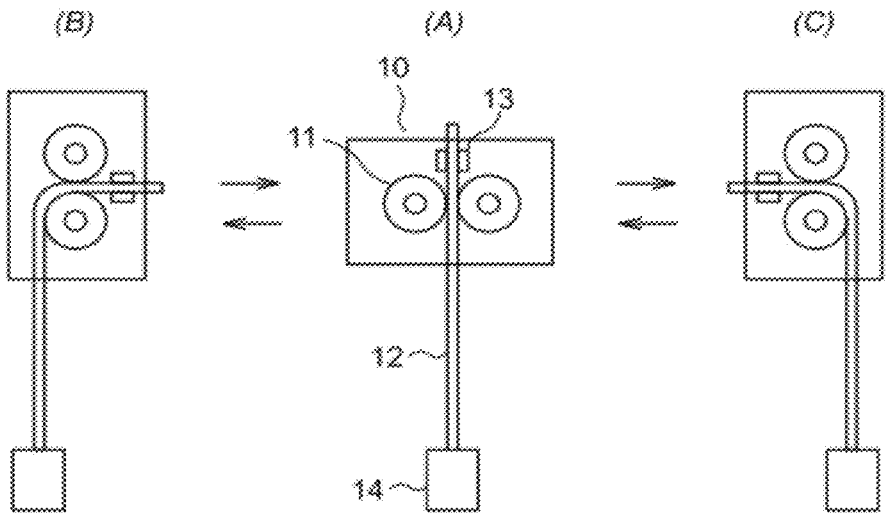
FIG. 7 is schematically illustrates a bending fatigue tester.

FIG. 7 is a front view of the bending fatigue tester. The bending life was measured using the bending fatigue tester. The bending fatigue tester comprises a bending head 10, a pair of oppositely arranged bending mandrels 11, a clamp 13 for securing a specimen 12 on the bending head 10, and a weight 14 for applying a load on the specimen 12. The tester repeatedly applies bending strains to the specimen to cause a tensile strain and a compression strain on the surface thereof.

The bending fatigue test is a test that repeatedly applies bending strains to the specimen to cause a tensile strain and a compression strain on the surface thereof while applying a load on the specimen. A wire as the specimen is set between the bending jigs (denoted as the mandrel in the figure) as illustrated in FIG. 7(A) and is applied with a load, and then the jig rotates 90° as illustrated in FIG. 7(B) to give a bend to the specimen with the load applied. With this movement, the wire is given a compression strain on its surface contacting with the jig and, at the same time, is given a tensile strain on its opposite surface. And then, the jig returns to the state illustrated in FIG. 7(A) again. On returning, the jig gives another 90° bending in the direction opposite to the direction illustrated in FIG. 7(B). In this bending, the wire is also given a compression strain on its surface contacting with the jig and, at the same time, is given a tensile strain on its opposite surface, and the wire becomes in the state illustrated in FIG. 7(C). And then, the bending state returns to the original state illustrated in FIG. 7(A) form the state of FIG. 7(C). This one bending-fatigue cycle, FIG. 7(A)→FIG. 7(B)→FIG. 7(C)→FIG. 7(A), takes four seconds. The bending strain on surface can be obtained by the formula given below.

$$\text{Bending strain on surface } (\%) = r/(R+r) \times 100$$

(Where, R: Bending radius of wire (specimen), 30 mm; r: Radius of wire (specimen))

Figure 8:
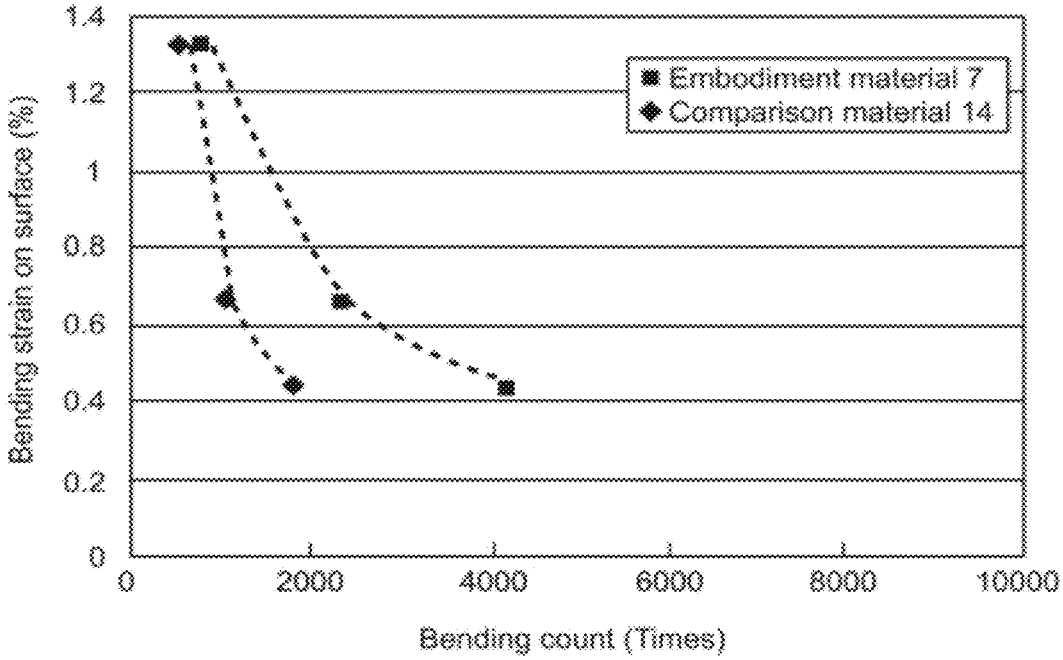
FIG. 8 is a graph that indicates measured bending life of comparison material 14 provided using oxygen free copper and embodiment material 7 provided using an annealed dilute copper alloy wire manufactured with addition of—Ti to a low oxygen copper, wherein both materials are annealed at 400° C. for 1 hour before testing.

FIG. 8 is a graph that indicates the measurements of bending lives of Comparison material 14 that uses oxygen free copper and Embodiment material 7 that uses such an annealed dilute copper alloy wire as includes 13 mass-ppm of Ti among Embodiment material 1. The specimens were provided using wires of 0.26 mm diameter, which were annealed at 400° C. for one hour; the composition of Comparison material 14 is same as that of Comparison material 12 and the composition of Embodiment material 7 is same as that of Embodiment material 5. The annealed dilute copper alloy wire by the present invention is required to have a long bending life. As shown in the experimental data indicated in FIG. 8, Embodiment material 7 by the present invention showed a longer bending life than that of Comparison material 14.

Figure 9:
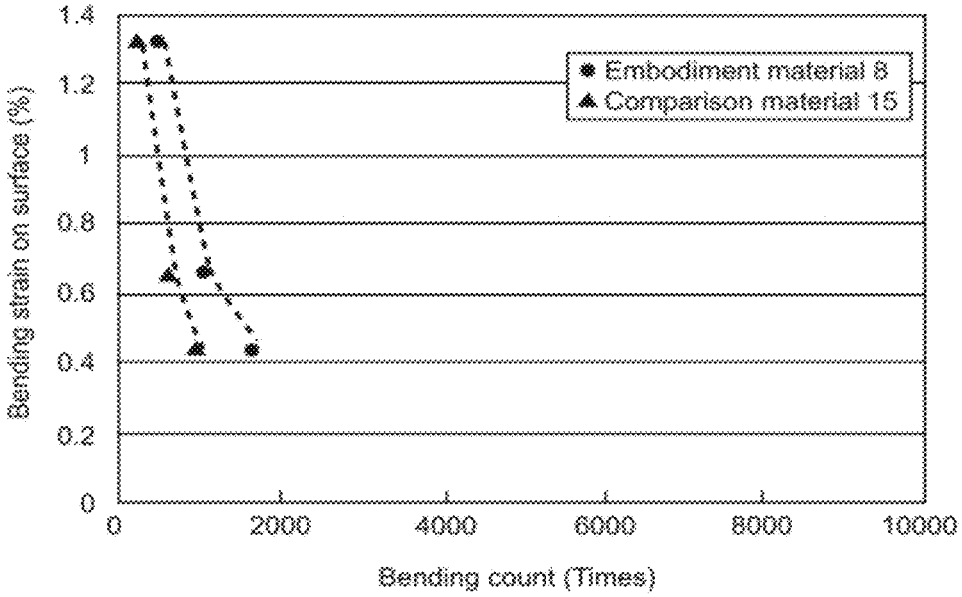
FIG. 9 is a graph that indicates measured bending life of comparison material 15 provided using oxygen free copper and embodiment material 7 provided using an annealed dilute copper alloy wire manufactured with addition of Ti to a low oxygen copper, wherein both materials are annealed at 600° C. for 1 hour before testing.

FIG. 9 is a graph that indicates the measurements of bending lives of Comparison material 15 that uses oxygen free copper and Embodiment material 8 that uses such an annealed dilute copper alloy wire that titanium was added to low oxygen copper. The specimens were provided using wires of 0.26 mm diameter, which were annealed at 600° C. for one hour; the composition of Comparison material 15 is same as that of Comparison material 11 and the composition of Embodiment material 8 is same as that of Embodiment material 5. The measuring for the bending life was conducted under the same conditions as indicated in FIG. 8. In this test, Embodiment material 8 by the present invention showed a longer bending life than that of Comparison material 15. It is understood that this result comes from the fact that Embodiment materials 7 and 8 have a 0.2% proof stress larger than that of Comparison materials 14 and 15 under any annealing conditions stated above.

(Crystal Structure of Annealed Dilute Copper Alloy Wire)

Figure 10:
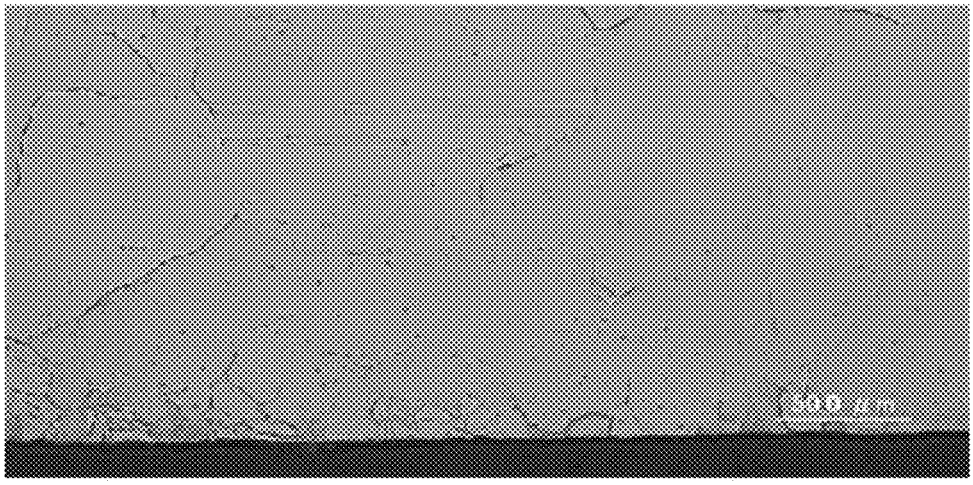
FIG. 10 is a photograph of sectional texture of embodiment material 8 taken in the across-the-width direction.
Figure 11:
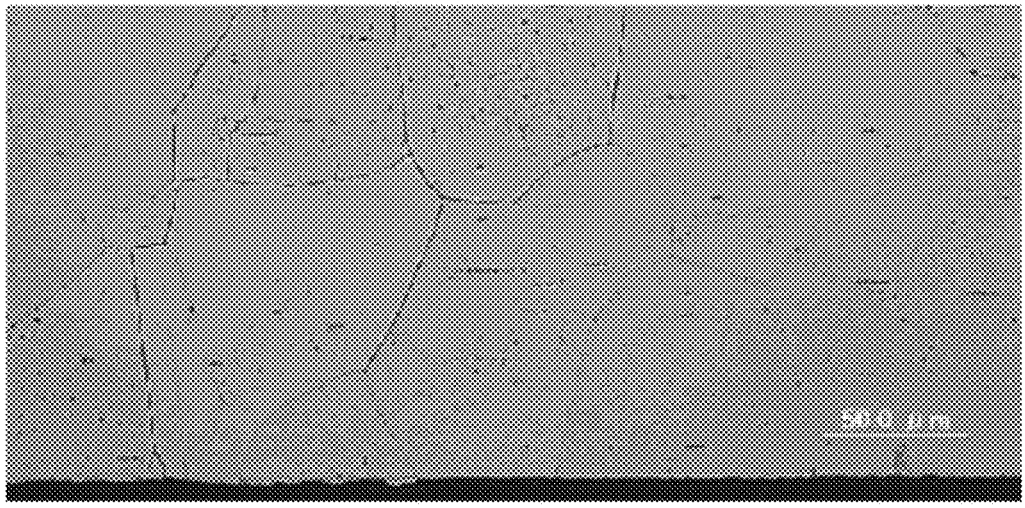
FIG. 11 is a photograph of sectional texture of embodiment material 5 taken in the across-the-width direction.

FIG. 10 is a photograph that shows the cross section of texture sectioned in the across-the-width direction of the specimen of Embodiment material 8 and FIG. 11 is a photograph that shows the cross section of texture sectioned in the across-the-width direction of the specimen of Comparison material 15.

As can be known from these photographs, the crystal structure of Comparison material 15 is such that the crystal grains of equal size are uniformly distributed all over from the surface area to the central area. In contrast to this, the crystal structure of Embodiment material 8 is such that the size of crystal grains are generally sporadic. It should be particularly noted that the sizes of crystal grains in the layer thinly formed around the surface in the cross-sectional direction of the specimen is extremely small compared to the sizes of crystal grains in the inner area thereof.

The inventors of the present invention think that the layer of fine crystal grains appeared on the surface-layer, which was not formed in Comparison material 15, has contributed to the improvement in the bending properties of Embodiment material 8. This comes from an interpretation as follows. Although it is understood that a heat treatment of annealing at 600° C. for one hour generally causes recrystallization to form uniformly coarsened crystal grains, in the present invention however, a layer of fine crystal grains still remain in fact in the surface-layer even after a heat treatment of annealing at 600° C. for one hour. Therefore, annealed dilute copper alloy having good bending properties is obtained though the origin of material is an annealed copper.

Figure 12:
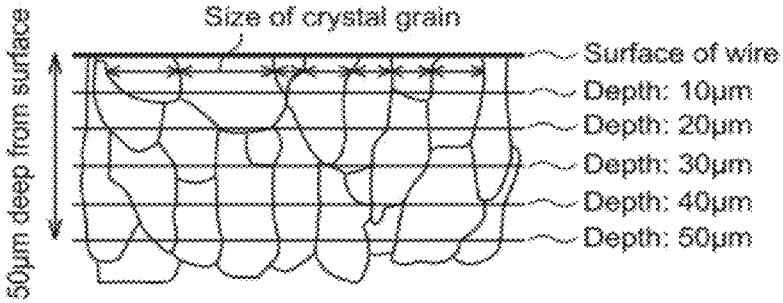
FIG. 12 is a schematic diagram for explanation of the method of measuring the average size of crystal in the surface-layer of the specimen.

FIG. 12 is an explanatory illustration of the method for measuring the average size of crystal grains in the surface-layer.

Measuring was conducted for the average size of crystal grains in the surface-layer of Embodiment material 8 and Comparison material 15 using the cross-sectional photography of the crystal structure shown in FIG. 10 and FIG. 11. The determination of the average size of crystal grains in the surface-layer was made in such a manner that the widths of grains were measured along a line that traverses the grains for the extent of the line length of 1 mm, wherein the lines were drawn at an interval of 10 μm in the across-the-width direction of the wire of 2.6 mm in diameter from the surface thereof to a depth of 50 μm, and measurements of widths of grains thus obtained were summed to calculate the average value. The average value thus calculated was adopted as the average size of crystal grains in the surface-layer.

The measurements showed that there was a great difference in that the average size of crystal grains in the surface-layer of Comparison material 15 was some 50 μm but in contrast the average size of crystal grains in the surface-layer of Embodiment material 8 was 10 μm. It is thought that the average size of crystal grains in the surface-layer being fine controlled the growth of cracks generated by the bending fatigue test with the result of elongated bending fatigue life. (When the size of crystal grain is large, the crack grows along the crystal boundary; but when the size of crystal grain is small, the direction of crack growth changes with its development suppressed.) These aspects is understood as the reason for such big difference in the bending properties between Comparison material and Embodiment material.

The average sizes of crystal grains in the surface-layers of Embodiment material 6 and Comparison material 13, each of which was wires of 2.6 mm diameter, were measured at the depth of 50 μm from the surface of the wire of 2.6 mm diameter in the across-the-width direction thereof for the longitudinal range of 10 mm. The measurements were such that the average size of crystal grains of Comparison material 13 in the surface-layer thereof was 100 μm and, in contrast to that, the average size of crystal grains of Embodiment 6 at the depth of 30 μm from the surface-layer thereof was 20 μm. To realize the advantageous effects of the present invention, the upper limit of the average size of crystal grain in the surface-layer is preferably to be 200 μm or smaller; but, due to manufacturing limit, 5 μm or larger is the anticipated minimum.

As stated above, any of Embodiment materials 5-8 by the present invention gains excellent properties, namely, they all are low in hardness, high in durability, and large in bending counts.

Embodiment 1

Embodiment Mode 2

Figure 13:
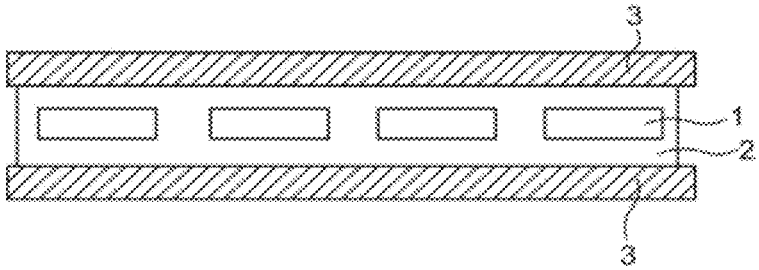
FIG. 13 is illustrates a sectional view of the flexible flat cable by the present invention.

FIG. 13 is a cross-sectional view of a flexible flat cable in the embodiment. As illustrated in FIG. 13, the flexible flat cable has such a construction: that multiple number of flat conductors 1 by the present invention are arrayed flat on one common plane; that the array of the flat conductors is sandwiched between insulating films 3 from the direction of the flat-face of conductor, wherein one face of each of the insulating films has an adhesive layer 2 and the films are applied so that each of the adhesive layers 2 will be the inner face of the sandwich on the array of the conductors; and that the sandwich of the array of the flat conductors are fused by heating so that the constituting members are integrally one-bodied. The adhesive layer 2 is fused into one body in the area between the faces of the flat conductors 1 and in the area of both outer sides of the flat conductor. The following describes the embodiment of the present invention together with a comparison example.

The embodiment is a flexible flat cable having a construction illustrated in FIG. 13. The flexible flat cable was manufactured using materials: a flat conductor of 0.2 mm wide and 0.02 mm thick manufactured by rolling a tinned (Sn-plated) wire of an alloy provided using the material listed as the third specimen indicated on the third line from the top in the row for Embodiment material 1 in Table. 1 with addition of 3 mass-ppm of titanium, polyethylene terephthalate (PET) film as the insulating film, and polyester as the adhesive layer. The manufacturing method for above-stated alloy wire used in the cable is as follows. A wire rod of 8 mm diameter was manufactured through SCR continuous casting-directed rolling at a molten copper temperature of 1320° C. followed by hot-rolling at the head end roll temperature of 880° C. or lower and the finish roll temperature of 550° C. or higher. The wire rod thus manufactured was drawn into a wire of 32 μm diameter, which was further processed into a flat conductor followed by annealing. The average size of crystal grains inside the flat wire thus manufactured was about 50 μm and a layer of fine grains of crystal of the average size of about 10 μm was formed at the depth of 50 μm from the surface.

(Comparison Material 14)

An FFC was manufactured in a manner similar to Embodiment 1 using oxygen free copper (OFC) as its conductor.

(Comparison Material 15)

An FFC was manufactured in a manner similar to Embodiment 1 using tough pitch copper (TPC) as its conductor.

(Comparison Material 16)

An FFC was manufactured in a manner similar to Embodiment 1 using a Cu-0.3% Sn alloy as its conductor.

TABLE 5

| | Embodiment Material | Comparison Material 14 (OFC) | Comparison Material 15 (TPC) | Comparison Material 16 (Cu-Sn alloy) |
|---|---|---|---|---|
| Bending Test | ○ | Δ | ○ | ○ |
| Conductivity (%) | ○ | ○ | x | x |

Note:
Mark ○ denotes property is good, Δ comparatively good, and x not acceptable.

Table 5 lists results of bending test and the conductivity of this embodiment.

The bending test was conducted by imposing a right-left 90° bending using the bending tester described previously under similar testing conditions. In the evaluation of the bending test results, the mark ○ was given where the result was superior taking the property exhibited by Comparison material 14 as the reference and the mark Δ was given where the result was comparable to the property exhibited by Comparison material 1.

In the evaluation of the conductivity, the mark ○ was given where the conductivity was comparable taking the conductivity exhibited by Comparison material 14 as the reference and the mark x was given where the conductivity was low taking the conductivity exhibited by Comparison material 14.

The bending counts of the constructions in Comparison materials 15 and 16 exhibited larger number of times than that of Comparison material 14 that uses OFC material; however, the conductivity of each of materials was inferior to that of Comparison material 14.

In contrast to this, it was found that the bending counts of the construction in Embodiment material 1 exhibited larger number of times than that of Comparison material 14 and that the construction had an equivalent level in terms of the conductivity.

As stated above, this embodiment has such a recrystallized texture that, in the inner area, larger size of crystal grains are distributed and, in the outer area, smaller size of crystal grains are distributed. By virtue of this, a flexible flat cable having large bending counts and a high conductivity was obtained.

The invention claimed is:

1. A flexible flat cable comprising conductors and insulating films applied over the conductors, wherein said conductor is comprised of 4 to 25 mass-ppm of Ti, 3 to 12 mass-ppm of sulfur, more than 2 mass-ppm and less than or equal to 30 mass-ppm of oxygen, and the balance being inevitable impurity and copper, wherein said Ti and sulfur are dispersed in crystal grains of said copper in a form of TiO, $TiO_2$, TiS and Ti—O—S as chemical compounds or aggregations, wherein said conductor has such a recrystallized texture that the size of crystal grains in the inner area of said conductor is larger than that of crystal grains in the surface-layer thereof, and wherein both sides of said conductor are sandwiched between insulating films.

2. The flexible flat cable according to claim 1, wherein said conductor has a conductivity of 101.5% IACS (International Annealed Copper Standard) or higher.

3. The flexible flat cable according to claim 1, wherein said TiO, $TiO_2$, TiS and Ti—O-S have a size of 200 nm or smaller, a size of 100 nm or smaller, a size of 200 nm or smaller, and a size of 300 nm or smaller, respectively.

4. The flexible flat cable according to claim 1, wherein said conductor has a half-softening temperature of 148° C. or lower.

* * * * *